US011365090B2

(12) United States Patent
Shibata et al.

(10) Patent No.: US 11,365,090 B2
(45) Date of Patent: Jun. 21, 2022

(54) ELEVATOR DEVICE

(71) Applicant: MITSUBISHI ELECTRIC CORPORATION, Chiyoda-ku (JP)

(72) Inventors: Masunori Shibata, Chiyoda-ku (JP); Kunimitsu Kishimoto, Chiyoda-ku (JP); Takuo Kugiya, Chiyoda-ku (JP); Norikazu Ito, Chiyoda-ku (JP); Masayuki Kakio, Chiyoda-ku (JP)

(73) Assignee: MITSUBISHI ELECTRIC CORPORATION, Chiyoda-ku (JP)

( * ) Notice: Subject to any disclaimer, the term of this patent is extended or adjusted under 35 U.S.C. 154(b) by 881 days.

(21) Appl. No.: 16/093,824

(22) PCT Filed: May 23, 2016

(86) PCT No.: PCT/JP2016/065132
§ 371 (c)(1),
(2) Date: Oct. 15, 2018

(87) PCT Pub. No.: WO2017/203558
PCT Pub. Date: Nov. 30, 2017

(65) Prior Publication Data

US 2019/0077633 A1 Mar. 14, 2019

(51) Int. Cl.

| | |
|---|---|
| ***B66B 5/00*** | (2006.01) |
| ***B66B 1/06*** | (2006.01) |
| ***B66B 5/28*** | (2006.01) |

(52) U.S. Cl.
CPC ..... *B66B 5/0087* (2013.01); *B66B 1/06* (2013.01); *B66B 5/00* (2013.01); *B66B 5/005* (2013.01); *B66B 5/288* (2013.01); *B66B 5/0012* (2013.01)

(58) Field of Classification Search
CPC ..... B66B 5/0087; B66B 5/00; B66B 5/005; B66B 5/288; B66B 5/0012; B66B 5/0025; B66B 5/0031; B66B 5/0056; B66B 1/06
See application file for complete search history.

(56) References Cited

U.S. PATENT DOCUMENTS 5,025,895 A * 6/1991 Leone ..... B66B 5/0031 187/390
5,347,094 A * 9/1994 Leone ..... B66B 5/0031 187/390

(Continued)

FOREIGN PATENT DOCUMENTS

CN 101883730 A * 11/2010 ..... B66B 5/0043
DE 10108772 A1 * 11/2002 ..... B66B 13/24

(Continued)

OTHER PUBLICATIONS

International Search Report dated Jul. 12, 2016 in PCT/JP2016/065132 filed May 23, 2016.

*Primary Examiner* — Michael A Riegelman
(74) *Attorney, Agent, or Firm* — Oblon, McClelland, Maier & Neustadt, L.L.P.

(57) ABSTRACT

An elevator device including on-car presence detection units, each being configured to detect presence of a person on top of a corresponding one of cars, on-car operation panels, each to be operated for a manual operation of the corresponding one of cars, and an elevator control device including a car operation approval unit configured to approve or cancel the operation on the on-car operation panels. When the on-car presence detection units have detected the presence of persons on top of the plurality of cars, the operation on the on-car operation panels of all the cars is canceled by the car operation approval unit. When the on-car presence detection unit has detected the presence of a person on top of one of the plurality of cars, the car (Continued)

operation approval unit approves the operation on the on-car operation panel of any one of the plurality of cars.

7 Claims, 7 Drawing Sheets

(56) References Cited

U.S. PATENT DOCUMENTS

| | | | | |
|---|---|---|---|---|
| 6,202,797 | B1 * | 3/2001 | Skolnick | B66B 5/005 187/391 |
| 10,118,798 | B2 * | 11/2018 | Kattainen | B66B 5/0031 |
| 10,221,042 | B2 * | 3/2019 | Haapaniemi | B66B 5/22 |
| 2008/0245619 | A1 * | 10/2008 | Monzon-Simon | B66B 5/0062 187/393 |
| 2011/0240413 | A1 * | 10/2011 | Madar | B66B 5/0056 187/343 |
| 2016/0107862 | A1 * | 4/2016 | Kattainen | B66B 5/005 187/247 |
| 2016/0325965 | A1 * | 11/2016 | Haapaniemi | B66B 5/0062 |
| 2019/0077633 | A1 * | 3/2019 | Shibata | B66B 5/288 |
| 2020/0223663 | A1 * | 7/2020 | Bastelli | B66B 5/16 |
| 2020/0283263 | A1 * | 9/2020 | Studer | B66B 5/0037 |
| 2021/0395040 | A1 * | 12/2021 | Toritani | B66B 5/04 |
| 2022/0048731 | A1 * | 2/2022 | Russell | B66B 1/3423 |

FOREIGN PATENT DOCUMENTS

| | | | | |
|---|---|---|---|---|
| JP | 11-322214 | A | 11/1999 | |
| JP | 2003-341951 | A | 12/2003 | |
| JP | 2005-206346 | A | 8/2005 | |
| WO | WO 2008/062500 | A1 | 5/2008 | |
| WO | WO-2019063407 | A1 * | 4/2019 | B66B 1/3461 |

* cited by examiner

WITH BUFFER CAP MOUNTED

WITH BUFFER CAP MOUNTED

FIG. 6

| DETECTION OF PRESENCE ON TOP OF CAR | DETECTION OF PRESENCE IN CAR | DETECTION OF INSTALLATION OF BUFFER CAP | ON-CAR OPERATION PANELS | IN-CAR OPERATION PANELS |
|---|---|---|---|---|
| NOT DETECTED | NOT DETECTED | NOT DETECTED | CANCELED | APPROVED |
| NOT DETECTED | NOT DETECTED | DETECTED | CANCELED | APPROVED |
| NOT DETECTED | DETECTED | NOT DETECTED | CANCELED | CANCELED |
| NOT DETECTED | DETECTED | DETECTED | CANCELED | CANCELED |
| DETECTED FOR ONLY ONE CAR | NOT DETECTED | NOT DETECTED | CANCELED | CANCELED |
| DETECTED FOR ONLY ONE CAR | NOT DETECTED | DETECTED | APPROVED | CANCELED |
| DETECTED FOR ONLY ONE CAR | DETECTED | NOT DETECTED | CANCELED | CANCELED |
| DETECTED FOR ONLY ONE CAR | DETECTED | DETECTED | CANCELED | CANCELED |
| DETECTED FOR PLURALITY OF CARS | NOT DETECTED | NOT DETECTED | CANCELED | CANCELED |
| DETECTED FOR PLURALITY OF CARS | NOT DETECTED | DETECTED | CANCELED | CANCELED |
| DETECTED FOR PLURALITY OF CARS | DETECTED | NOT DETECTED | CANCELED | CANCELED |
| DETECTED FOR PLURALITY OF CARS | DETECTED | DETECTED | CANCELED | CANCELED |

ELEVATOR DEVICE

TECHNICAL FIELD

The present invention relates to an elevator device, and more particularly, to an elevator device including a plurality of cars installed in the same hoistway.

BACKGROUND ART

Maintenance and inspection work for elevators is carried out on top of a car of an elevator by a maintenance worker. Therefore, as preparation work for ensuring security, the maintenance worker first operates an inspection switch disposed on top of the car of the elevator. With the operation, a signal is transmitted from the inspection switch to an elevator control device. Asa result, an operation mode of the elevator is switched from a "normal mode" to an "inspection mode". In the "inspection mode", an operation speed is a low speed suitable for inspection work, and at the same time, a car call and a landing call are not accepted.

Further, there is a gap between a periphery of the car and walls of a hoistway. Therefore, the maintenance worker is required to perform the work with a safety belt on so that the maintenance worker on top of the car does not fall into the gap.

However, the maintenance worker operates the inspection switch and confirms wearing of the safety belt by himself or herself. Therefore, the maintenance and inspection work may be carried out without the operation of the inspection switch or wearing of the safety belt.

Therefore, for example, in a safety device for an elevator, which is described in Patent Literature 1, the following is proposed. Specifically, the safety device includes an on-car detection unit configured to detect that the maintenance worker has moved onto top of the car, the inspection switch configured to perform an operation for changing the operation mode of the elevator to the inspection mode, and a safety-belt use detection unit configured to detect that the maintenance worker has worn the safety belt. When it is detected that the maintenance worker has moved onto top of the car, the operation mode of the elevator is switched to an operation inhibition mode. When both of the inspection switch and the safety-belt use detection unit are in operation, the operation mode of the elevator is switched from the operation inhibition mode to the inspection mode.

CITATION LIST

Patent Literature

[PTL 1] JP 11-322214 A

SUMMARY OF INVENTION

Technical Problem

In the related-art safety device for an elevator, which is described in Patent Literature 1, only a single car is intended to run in the same hoistway, and therefore running of a plurality of cars in the same hoistway is not intended. Therefore, in a case where the plurality of cars run in the same hoistway, the presence or absence of the maintenance workers on top of the plurality of cars cannot be detected with the related-art device described in Patent Literature 1.

Therefore, when a plurality of maintenance workers perform the work at the same time on top of different cars, there is a problem in that work efficiency is reduced because of need of cooperation among the plurality of maintenance workers.

The present invention has been made to solve the problems described above, and has an object to provide an elevator device including a plurality of cars installed in the same hoistway, which enables high workability at the time of maintenance and inspection work by eliminating need of cooperation among a plurality of maintenance workers to prevent reduction in work efficiency.

Solution to Problem

According to one embodiment of the present invention, there is provided an elevator device, which includes a plurality of cars installed in the same hoistway, the elevator device including: on-car presence detection units, each being configured to detect presence of a person on top of a corresponding one of the plurality of cars; on-car operation panels, each being disposed on top of a corresponding one of the plurality of cars and to be operated for a manual operation of the corresponding one of the plurality of cars; and a car operation approval unit configured to approve or cancel an operation on the on-car operation panels based on results of detection by the on-car presence detection units, wherein, when the on-car presence detection units have detected the presence of persons on two or more of the plurality of cars, the car operation approval unit cancels the operation on the on-car operation panels of all the plurality of cars, and wherein, when the on-car presence detection unit has detected the presence of a person on one of the plurality of cars, the car operation approval unit approves the operation on the on-car operation panel of any one of the plurality of cars.

Advantageous Effects of Invention

According to the embodiment of the present invention, when persons are present on top of two or more cars, the operation of the on-car operation panels are canceled for all the cars. When it is detected that a person is present on top of only one car, the operation of the on-car operation panel is approved only for any one of the plurality of cars. Therefore, the need of cooperation among the plurality of maintenance workers is eliminated to prevent reduction in work efficiency. Therefore, the elevator device enabling high workability at the time of maintenance and inspection work can be obtained.

BRIEF DESCRIPTION OF DRAWINGS

FIG. 6 is an example of a criterion table to be used by a car operation approval unit of the elevator device according to the first embodiment of the present invention.

DESCRIPTION OF EMBODIMENT

An elevator device according to an embodiment of the present invention is now described with reference to the drawings.

First Embodiment

Figure 1:
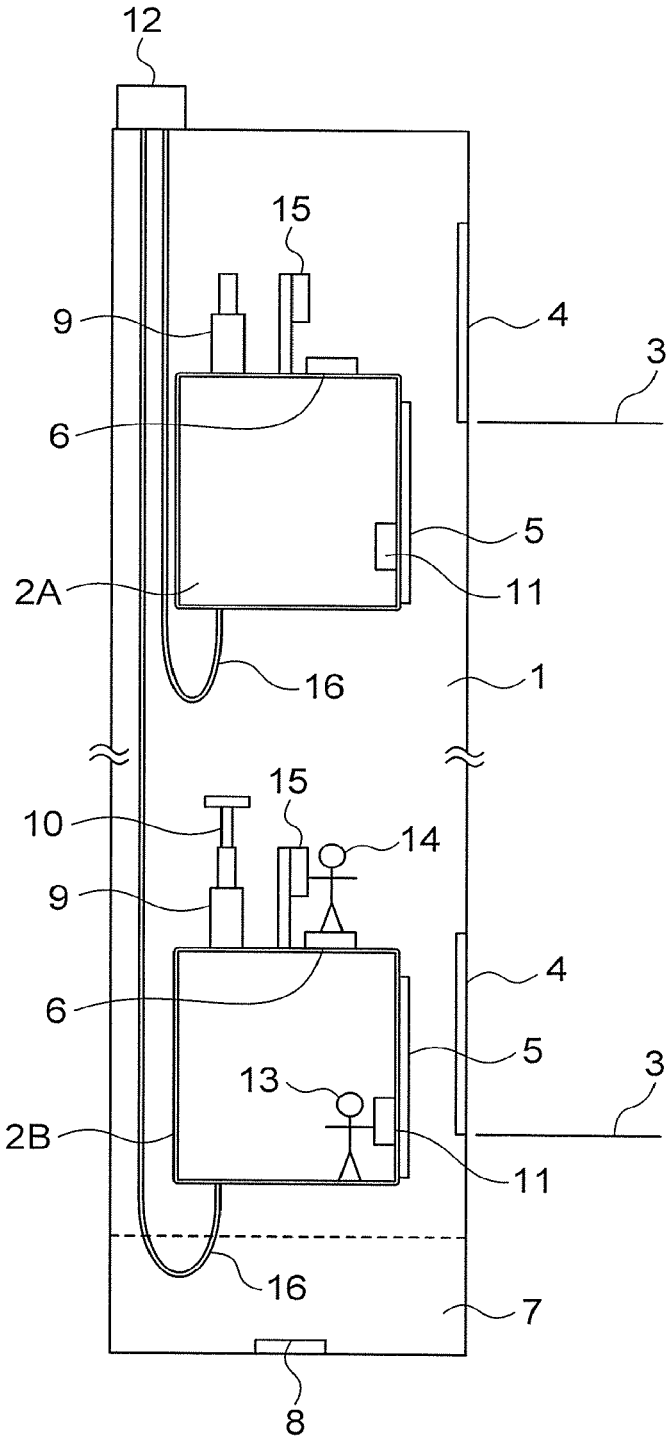
FIG. 1 is a configuration diagram for illustrating an overall configuration of an elevator device according to a first embodiment of the present invention.

FIG. 1 is a diagram for illustrating an overall configuration of an elevator device according to a first embodiment of the present invention. The elevator device according to the first embodiment is constructed of a multi-car elevator, in which a plurality of cars run in the same hoistway.

As illustrated in FIG. 1, a plurality of cars 2A and 2B are disposed inside a hoistway 1. Although the number of cars is described as two in the first embodiment, the number of cars is not limited thereto. The number of cars may be an appropriate number equal to or larger than two. In the following description, the plurality of cars 2A and 2B are collectively referred to as cars 2.

A landing door 4 is disposed to a landing 3 of each floor. A car door 5 is disposed to each of the cars 2A and 2B. A sensor (not shown) configured to detect opening of the door is disposed to each of the landing doors 4 and the car doors 5. When the car door 5 is not open and the landing door 4 is open, an operation mode of the elevator is switched to an inspection operation mode.

An on-car presence detection unit 6 is disposed onto top of each of the cars 2A and 2B. The on-car presence detection unit 6 detects a maintenance worker who is present on top of a corresponding one of the cars 2A and 2B. At a lower end of the hoistway 1, a pit 7 is formed. The pit 7 is a part of the hoistway 1, which is located below a floor surface of a bottom floor. In the pit 7, an in-pit presence detection unit 8 is disposed. The in-pit presence detection unit 8 detects the maintenance worker who is present in the pit 7. In the first embodiment, each of the on-car presence detection units 6 and the in-pit presence detection unit 8 is constructed of, for example, a weight scale. When detecting a weight larger than a predetermined threshold value, the on-car presence detection unit 6 detects that a person is present on top of the car, or the in-car presence detection unit 8 detects that a person is present in the pit.

On top of each of the cars 2A and 2B, a buffer 9, a buffer cap 10, and an on-car operation panel 15 are installed.

The buffer 9 is one of safety devices for the elevator. The buffer 9 installed on top of the car 2A is a device configured to ease a shock generated when the car 2A runs beyond a top floor to collide against an upper end of the hoistway 1 for some reason. Further, the buffer installed on top of the car 2B is a device configured to ease a shock generated when the car 2B approaches the car 2A to collide against a bottom of the car 2A for some reason. In general, the buffers include an oil buffer and a spring buffer. As the buffer 9, any of the oil buffer and the spring buffer may be used.

During a normal operation, the buffer cap 10 is accommodated in an accommodation location disposed to each of the cars 2A and 2B. The buffer cap 10 is mounted to the buffer 9 to be used at a time of maintenance and inspection work, as illustrated in FIG. 1. The buffer cap 10 is a member configured to abut against an obstacle that is present in a raising and lowering direction of the car to ensure an evacuation space in the raising and lowering direction. More specifically, the buffer caps 10 ensure the evacuation spaces for the maintenance worker between the car 2A and the upper end of the hoistway 1 and between the cars 2A and 2B.

In FIG. 2 and FIG. 3, examples of the buffer cap 10 are illustrated.

Figure 2A:
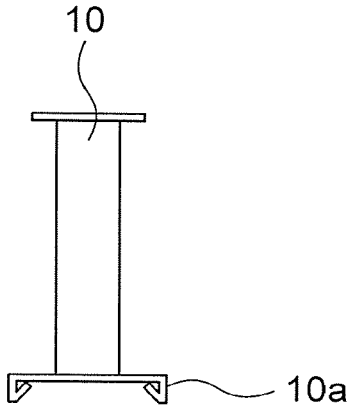
FIG. 2 are diagrams for illustrating an example of a configuration of a buffer cap of the elevator device according to the first embodiment of the present invention.
Figure 2B:
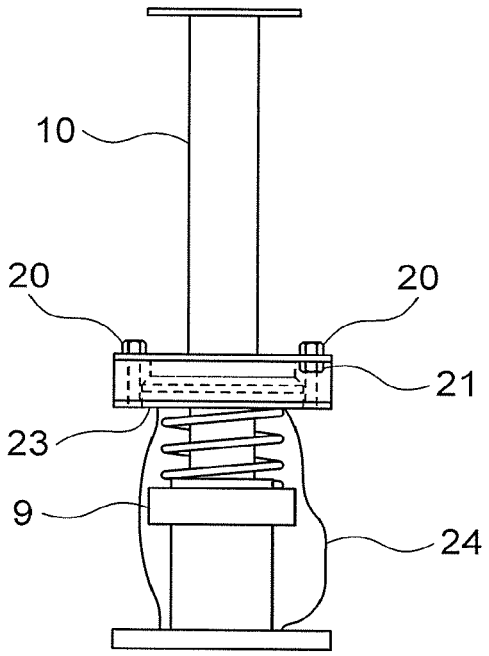

FIG. 2 are illustrations of an example of the buffer cap 10 constructed of the oil buffer. FIG. 2A is a side view of the buffer cap 10, and FIG. 2B is an illustration of a state in which the buffer cap 10 is mounted onto the buffer 9. As illustrated in FIG. 2B, when the buffer cap 10 is mounted, a dustproof cover 24 for the buffer 9 is first moved down to a position below a plunger cap 23 so that the buffer cap 10 is inserted from a side surface of the buffer 9. Next, the buffer cap 10 is fixed to the plunger cap 23 with bolts 20 and nuts 21. As illustrated in FIG. 2A, a contact sensor 10*a* is disposed to a lower end of the buffer cap 10. The contact sensor 10*a* detects that the buffer cap 10 is mounted to the buffer 9. This state corresponds to a state in which the buffer cap 10 is in a standby state on top of the car.

Figure 3A:
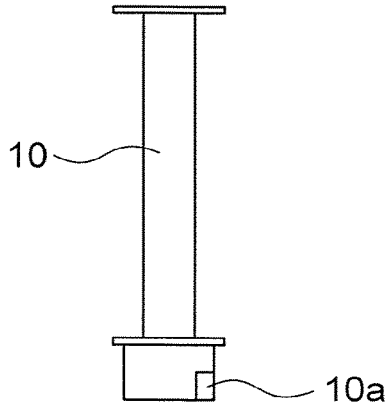
FIG. 3 are diagrams for illustrating another example of the configuration of the buffer cap of the elevator device according to the first embodiment of the present invention.
Figure 3B:
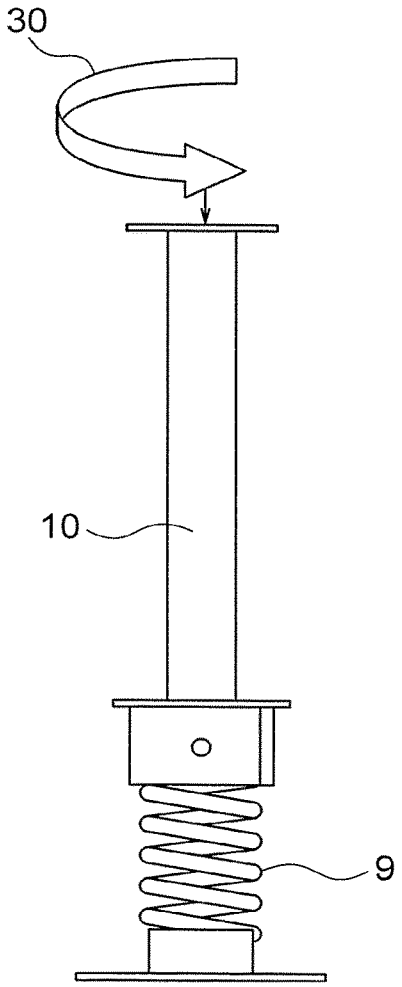

FIG. 3 are illustrations of an example of the buffer cap 10 constructed of the spring buffer. FIG. 3A is a side view of the buffer cap 10, and FIG. 3B is an illustration of a state in which the buffer cap 10 is mounted onto the buffer 9. As illustrated in FIG. 3B, when the buffer cap 10 is mounted, bolts on both sides of the buffer cap 10 are first loosened, and then the buffer cap 10 is placed on the buffer 9. Next, under this state, the bolts of the buffer cap 10 are tightened. Subsequently, the buffer cap 10 is turned in a direction indicated by an arrow 30 to be fixed to a spring included in the buffer 9. As illustrated in FIG. 3A, a contact sensor 10*a* is disposed to a lower end of the buffer cap 10. The contact sensor 10*a* detects that the buffer cap 10 is mounted to the buffer 9. This state corresponds to a state in which the buffer cap 10 is in a standby state on top of the car.

The on-car operation panel 15 is an operation panel configured to allow a maintenance worker 14 on top of the car to manually operate the cars 2A and 2B.

Further, as illustrated in FIG. 1, an in-car operation panel 11 is disposed in each of the cars 2A and 2B. The in-car operation panel 11 is an operation panel configured to allow a maintenance worker 13 in the cars 2A and 2B to manually operate the cars 2A and 2B.

When the operation mode of the elevator is the inspection operation mode, the manual operation is basically canceled for the on-car operation panels 15 and the in-car operation panels 11. As shown in a criterion table of FIG. 6 referred to later, the manual operation on the operation on the on-car operation panels 15 and the in-car operation panels 11 is approved only when preset criteria are met.

Figure 4:
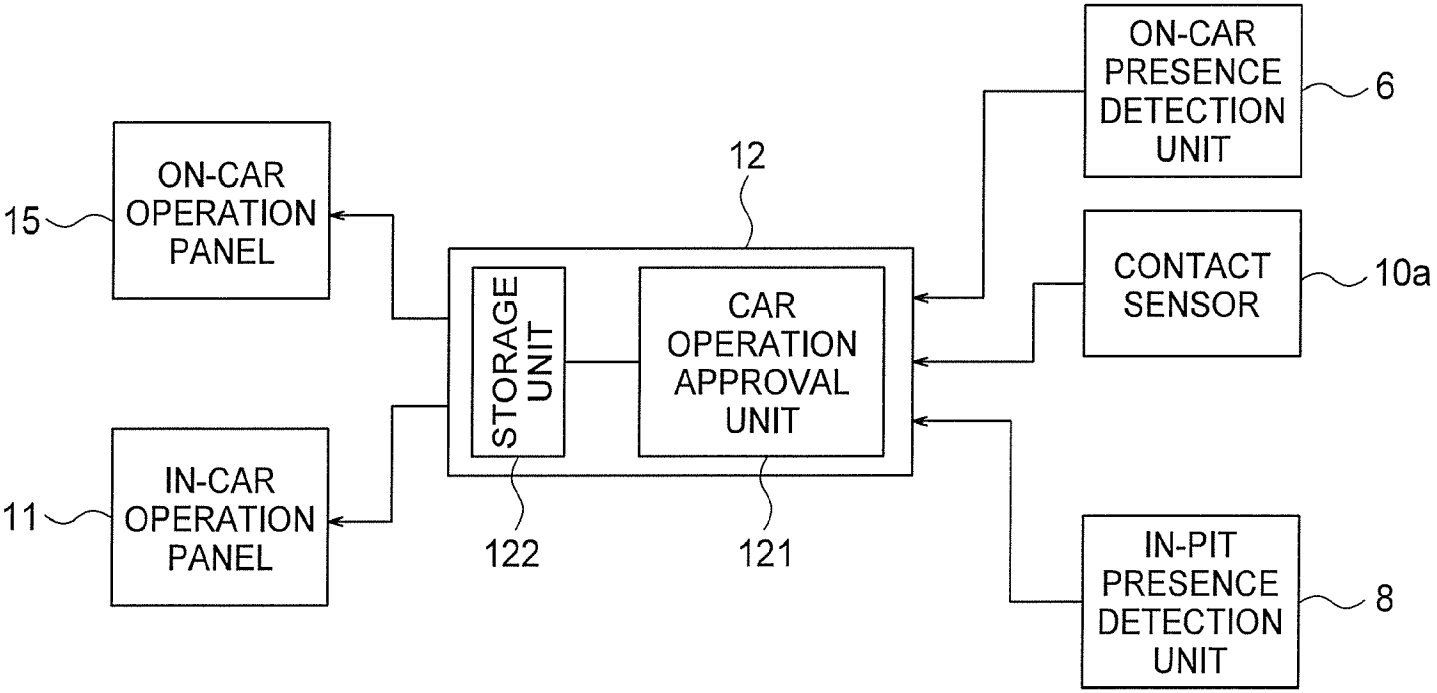
FIG. 4 is a block diagram for illustrating a configuration of an elevator control device of the elevator device according to the first embodiment of the present invention.

A machine room is disposed in an upper part of the hoistway 1. In the machine room, an elevator control device 12 is installed. The elevator control device 12 includes, as illustrated in FIG. 4, a car operation approval unit 121 and a storage unit 122. The on-car presence detection units 6, the in-pit presence detection unit 8, the contact sensors 10*a*, the on-car operation panels 15, and the in-car operation panels 11 are connected to the car operation approval unit 121 via traveling cables 16 illustrated in FIG. 1. The car operation approval unit 121 receives a result of detection from each of the on-car presence detection unit 6, the in-pit presence detection unit 8, and the contact sensor 10*a*. The car operation approval unit 121 determines approval or cancelation of the manual operation on the on-car operation panel 15 and the in-car operation panel 11 based on the above-mentioned results of detection.

Figure 5:
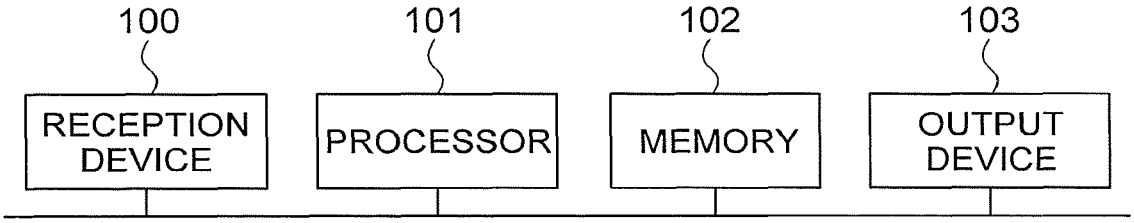
FIG. 5 is a block diagram for illustrating a hardware configuration of the elevator control device of the elevator device according to the first embodiment of the present invention.

The elevator control device 12 is constructed of, for example, a microcomputer. In FIG. 5, a hardware configuration of the elevator control device 12 is illustrated. The elevator control device 12 includes, as illustrated in FIG. 5, a reception device 100 configured to receive a signal from exterior, a processor 101, a memory 102, and an output device 103 configured to output a signal to the exterior. The car operation approval unit 121 included in the elevator control device 12 is achieved by execution of a program, which is stored in the memory 102, by the processor 101. Further, as illustrated in FIG. 4, the elevator control device includes the storage unit 122. The storage unit 122 is constructed of the memory 102. The memory 102 includes a ROM and a RAM. Although one processor and one memory are illustrated in FIG. 5, a plurality of processors and a plurality of memories may execute the above-mentioned functions in cooperation with each other.

The car operation approval unit 121 approves the operation on the on-car operation panel 15 or the in-car operation panel 11 in accordance with <Criterion 1> to <Criterion 5> described below based on the results of detection received from the on-car presence detection units 6, the in-pit presence detection unit 8, and the contact sensors 10*a*. In place of <Criterion 1>, <Criterion 1'> or <Criterion 1"> may be used.

<Criterion 1>: When it is detected by the on-car presence detection units 6 disposed on the cars 2A and 2B that a person is on top of only any one of the cars 2A and 2B, the car operation approval unit 121 approves the manual operation on the on-car operation panel 15 installed on the corresponding car.

<Criterion 1'>: In <Criterion 1> described above, the car operation approval unit 121 may also use the results of detection from the contact sensors 10*a*. In this case, in addition to <Criterion 1> described above, it is determined based on the result of detection by the contact sensor 10*a* whether or not the buffer cap 10 is installed vertically on top of the car on which the presence of a person has been detected. When the buffer cap 10 is installed vertically, the car operation approval unit 121 approves the manual operation on the on-car operation panel 15 installed on the corresponding car.

<Criterion 1">: In <Criterion 1> or <Criterion 1'> described above, the car operation approval unit 121 may also use the result of detection by the in-pit presence detection unit 8. In this case, in addition to <Criterion 1> or <Criterion 1'> described above, only when the presence of a person in the pit 7 is not detected, the car operation approval unit 121 approves the manual operation on the on-car operating plane 15 installed on the corresponding car.

<Criterion 2>: When the presence of a person on top of at least one car has been detected by the on-car presence detection units 6 disposed on top of the cars 2A and 2B, the car operation approval unit 121 cancels the operation on the in-car operation panels 11 of all the cars 2A and 2B. In this manner, when performing the operation on the in-car operation panel 11, the maintenance worker is not required to check the absence of a person on top of all the cars. Therefore, work efficiency is improved.

<Criterion 3>: When the buffer cap 10 is not installed vertically on top of at least one car based on the results of detection by the contact sensors 10*a* disposed on top of the cars 2A and 2B, the car operation approval unit 121 cancels the operation on the on-car operation panels 15 of all the cars 2A and 2B. In this manner, even when the car on top of which the maintenance worker is present approaches another car or the upper part of the hoistway by the manual operation performed by the maintenance worker by mistake, the evacuation space for the maintenance worker on top of the car can be ensured.

<Criterion 4>: When the presence of a person is not detected on top of any of the cars 2A and 2B by the on-car presence detection units 6 disposed on top of the cars 2A and 2B and the presence of a person is not detected by the in-pit presence detection unit 8 disposed in the pit 7, the car operation approval unit 121 approves the manual operations through the in-car operation panels 11. In this manner, when the maintenance worker in the car performs the manual operation, the absence of a person on top of all the cars and in the pit is not required to be checked. Therefore, the work efficiency is improved.

<Criterion 5>: When the presence of a person in the pit 7 is detected by the in-pit presence detection unit 8 disposed in the pit 7 or the presence of persons on top of the plurality of cars is detected by the on-car presence detection units 6 disposed on top of the respective cars 2A and 2B, the car operation approval unit 121 cancels the operation on the on-car operation panels 15 and the in-car operation panels 11 of all the cars installed in the same hoistway. In this manner, unintended movement of each of the cars for the maintenance worker who is present in the pit 7 or the maintenance worker who is present on top of the car 2A or 2B can be prevented.

A criterion table in which <Criterion 1> to <Criterion 5> described above are arranged is shown in FIG. 6. In FIG. 6, <Criterion 1"> is used in place of <Criterion 1>. The criterion table shown in FIG. 6 is stored in advance in the storage unit 122 of the elevator control device 12. The car operation approval unit 121 uses the results of detection received from the on-car presence detection units 6, the in-pit presence detection unit 8, and the contact sensors 10*a* to determine approval or cancelation of the operation on the on-car operation panels 15 or the in-car operation panels 11 in accordance with the criterion table stored in the storage unit 122.

Figure 7:
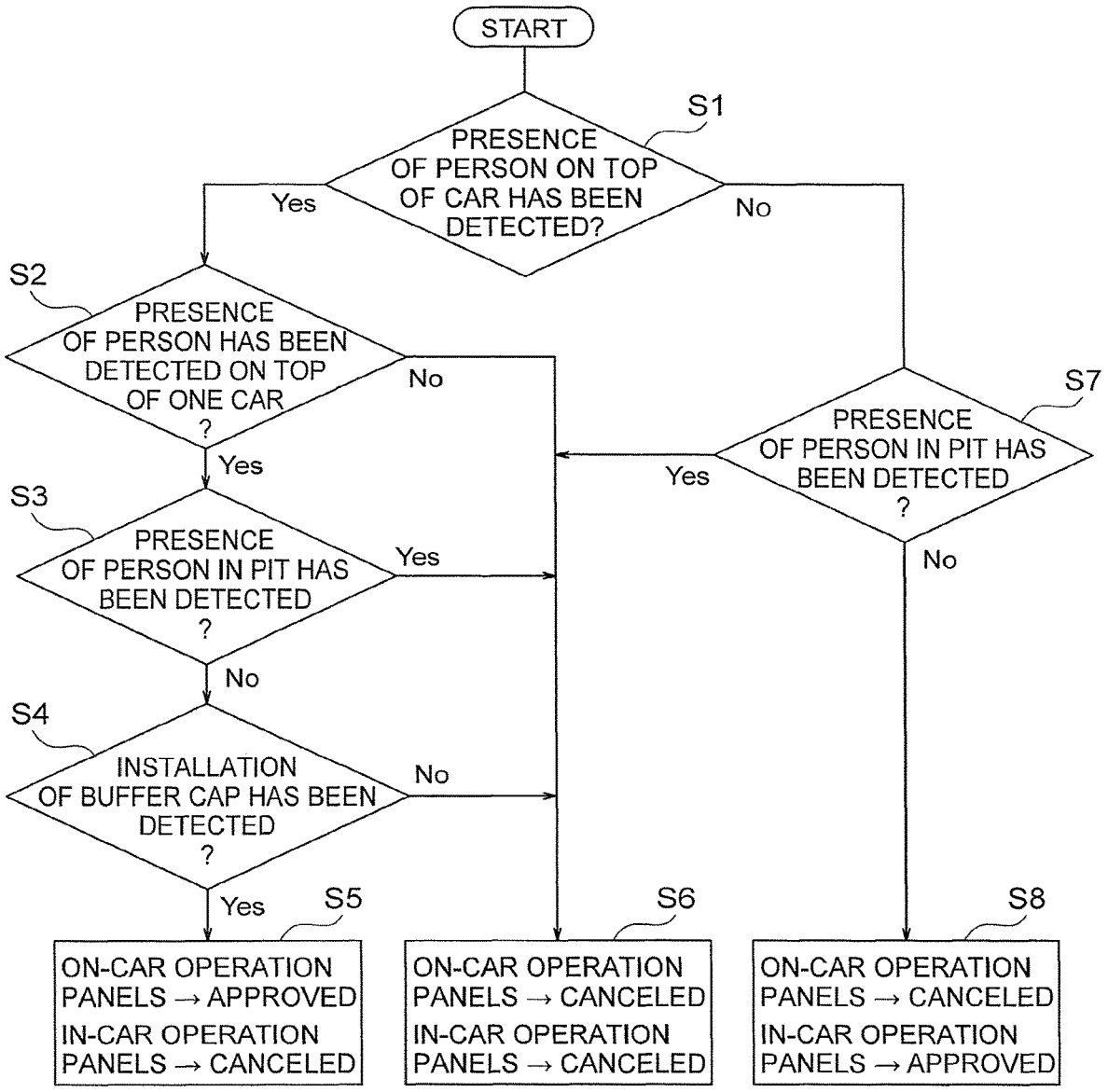
FIG. 7 is a flowchart for illustrating a flow of processing to be performed by the car operation approval unit of the elevator device according to the first embodiment of the present invention.

A flowchart of FIG. 7 is an illustration of an example of a flow of processing to be performed by the car-operation approval unit 121. The order of Step S1 to Step S4 and Step S7 of FIG. 7 for determination is merely an example, and the order of execution of the steps described above may be appropriately changed.

As illustrated in FIG. 7, in Step S1, the car operation approval unit 121 determines whether or not a person is present on top of any of the cars based on the results of detection by the on-car presence detection units 6 disposed on top of the cars 2A and 2B. As a result of the determination, when a person is present on top of at least one car, the processing proceeds to Step S2. Meanwhile, when a person is not present on top of any of the cars, the processing proceeds to Step S7.

In Step S2, the car operation approval unit 121 determines whether or not a person has been detected on top of one car or persons have been detected on top of the plurality of cars based on the results of detection by the on-car presence detection units 6 disposed on top of the cars 2A and 2B. When a person has been detected on top of one car, the processing proceeds to Step S3. When persons have been detected on top of the plurality of cars, the processing proceeds to Step S6.

In Step S3, the car operation approval unit 121 determines whether or not a person is present in the pit 7 based on the result of detection by the in-pit presence detection unit 8. When a person is present therein, the processing proceeds to Step S6. When a person is not present, the processing proceeds to Step S4.

In Step S4, the car operation approval unit 121 determines whether or not the buffer cap 10 is installed vertically based on the results of detection by the contact sensors 10*a*. When the buffer cap 10 is installed vertically, the processing proceeds to Step S5. When the buffer cap 10 is not installed vertically, the processing proceeds to Step S6.

In Step S5, the car operation approval unit 121 approves the manual operation on the on-car operation panel 15 and cancels the manual operation on the in-car operation panels 11.

In Step S6, the car operation approval unit 121 cancels the manual operation on the on-car operation panels 15 and the in-car operation panels 11.

Meanwhile, in Step S7, the car operation approval unit 121 determines whether or not a person is present in the pit 7 based on the result of detection by the in-pit presence detection unit 8. When a person is present in the pit 7, the processing proceeds to Step S6. When a person is not present therein, the processing proceeds to Step S8.

In Step S8, the car operation approval unit 121 cancels the manual operation on the on-car operation panels 15 and approves the manual operation on the in-car operation panels 11.

The elevator control device 12 has been described as being constructed of a microcomputer. However, the elevator control device 12 is not limited thereto, and may be constructed of a programmable logic device such as a CPLD or an FPGA.

Each of the on-car presence detection units 6 and the in-pit presence detection unit 8 has been described as being constructed of a weight scale. However, each of the on-car presence detection units 6 and the in-pit presence detection unit 8 is not limited thereto, and may be constructed of any of sensors including an infrared sensor, a light curtain, a temperature sensor, and a camera.

The on-car operation panel 15, the operation on which is approved by the car operation approval unit 121, has been described as that installed on the car on top of which the presence of a person has been detected by the on-car presence detection unit 6. Specifically, in the description given above, when the presence of the maintenance worker on top of the car 2A has been detected, the operation on the on-car operation panel 15 of the car 2A is approved. When the presence of the maintenance worker on top of the car 2B has been detected, the operation on the on-car operation panel 15 of the car 2B is approved. However, the approval of the manual operation of the car is not limited thereto. The manual operation of one car selected from all the cars installed in the same hoistway may be approved. Specifically, when the car operation approval unit 121 has detected the presence of the maintenance worker on top of the car 2A, the operation of the on-car operation panel 15 of one car selected from the cars 2A and 2B may be approved. When the presence of the maintenance worker on top of the car 2B has been detected, the operation of the on-car operation panel 15 of one car selected from the cars 2A and 2B may be approved.

Further, a detection value of the contact sensor 10*a* installed to the buffer cap 10 has been described as being used as information to be used for the determination of approval of the manual operation on the on-car operation panel 15. As the information, however, a detection value of a contact sensor configured to determine installation of a safety fence maybe used in place of the detection value of the contact sensor 10*a*. Alternatively, a distance between the cars, which is measured by a distance sensor installed between the cars, or a detection value of a limit switch installed on the car or in the hoistway may be used as the information.

Further, both of the in-pit presence detection unit 8 and the contact sensor 10*a* have been described as being disposed. However, the in-pit presence detection unit 8 and the contact sensor 10*a* are not limited thereto. Only any one of the in-pit presence detection unit 8 and the contact sensor 10*a* may be disposed.

As described above, in the first embodiment, the elevator device includes the plurality of cars 2 installed in the same hoistway 1. The elevator device includes the on-car presence detection units 6, each being configured to detect the presence of a person on top of a corresponding one of the cars, the on-car operation panels 15, each being disposed on top of a corresponding one of the cars and to be operated for the manual operation of the car, and the car-operation approval unit 121 configured to approve or cancel the operation on the on-car operation panels 15 based on the results of detection by the on-car presence detection units 6.

When the on-car presence detection units 6 have detected the presence of persons on top of two or more of the plurality of cars, the car operation approval unit 121 cancels the operation on the on-car operation panels 15 of all the cars.

When the on-car presence detection unit 6 has detected the presence of a person on top of one of the plurality of cars, the car operation approval unit 121 approves the operation on the on-car operation panel 15 of any one of the plurality of cars.

In this manner, when persons are present on top of two or more cars, the operation on the on-car operation panels 15 of all the cars is canceled. Therefore, unintended movement of each of the cars for the maintenance workers on top of the cars can be prevented. Further, when operating the on-car operation panel 15, the maintenance worker is not required to check the absence of a person on other cars. Therefore, the work efficiency is improved.

Further, in the first embodiment, the in-pit presence detection unit 8, which is installed in the pit 7 formed at the lower end of the hoistway 1 and is configured to detect the presence of a person in the pit 7, is provided as required.

In this case, when the in-pit presence detection unit 8 has detected the presence of a person in the pit 7, the car operation approval unit 121 cancels the operation on the on-car operation panels 15 of all the plurality of cars regardless of the results of detection by the on-car presence detection units 6.

In this manner, unintended movement of each of the cars for the maintenance worker who is present on top of the car and the maintenance worker who is present in the pit can be prevented.

Further, when the on-car presence detection unit 6 has detected the presence of a person on top of only one of the plurality of cars and the in-pit presence detection unit 8 has not detected the presence of a person in the pit 7, the car operation approval unit 121 approves the operation on the on-car operation panel 15 of one of the plurality of cars.

In this manner, when operating the on-car operation panel 15, the maintenance worker is not required to check the absence of a person in the pit 7. Therefore, the work efficiency is improved.

Further, in the first embodiment, the buffer cap 10 is prepared at the time of maintenance work as required. The buffer cap 10 is installed on top of each of the cars and abuts against the obstacle that is present in the raising and lowering direction to function as an evacuation space ensuring portion configured to ensure the evacuation space in the raising and lowering direction. When the buffer cap 10 is used, the contact sensor 10*a* serving as an evacuation space ensuring detection unit configured to detect that the buffer cap 10 has been prepared on top of each of the cars is also prepared.

In this case, when the car for which the buffer cap 10 is not prepared has been detected from the plurality of cars by the contact sensor 10*a*, the car operation approval unit 121 cancels the operation on the on-car operation panels 15 of all the plurality of cars regardless of the results of detection by the on-car presence detection units 6.

Further, when the on-car presence detection unit 6 has detected the presence of a person on top of one of the plurality of cars and the contact sensor 10*a* has detected that the buffer cap 10 is prepared on top of the corresponding car, the car operation approval unit 121 approves the operation on the on-car operation panel 15 for one of the plurality of cars.

In this manner, only when the buffer cap 10 is installed vertically, the operation on the on-car operation panel 15 is approved. Therefore, when operating the on-car operation panel 15, the maintenance worker is not required to check the absence of a person on top of another car. Therefore, the work efficiency is improved. Further, even when the car on top of which the maintenance worker is present approaches another car or the upper part of the hoistway by the manual operation performed by the maintenance worker by mistake, the evacuation space for the maintenance worker on top of the car can be ensured.

Further, in a case where the buffer cap 10 is used and the in-pit presence detection unit 8 is disposed, when the car for which the buffer cap 10 is not prepared has been detected from the plurality of cars by the contact sensor 10*a*, the car operation approval unit 121 cancels the operation on the on-car operation panels 15 of all the plurality of cars regardless of the results of detection by the on-car presence detection units 6 and the result of detection by the in-pit presence detection unit 8.

Further, when the on-car presence detection unit 6 has detected the presence of a person on top of one of the plurality of cars, the contact sensor 10*a* has detected that the buffer cap 10 is prepared on top of the corresponding car, and the in-pit presence detection unit 8 has not detected the presence of a person in the pit 7, the car operation approval unit 121 approves the operation on the on-car operation panel 15 of one of the plurality of cars.

In this manner, unintended movement of each of the cars for the maintenance worker on top of the car and the maintenance worker in the pit under a state in which the buffer cap 10 is not prepared can be prevented. Further, when operating the on-car operation panel 15, the maintenance worker is not required to check the absence of a person on top of another car or in the pit. Further, even when the car on top of which the maintenance worker is present approaches another car or the upper part of the hoistway by the manual operation performed by the maintenance worker by mistake, the evacuation space for the maintenance worker on top of the car can be ensured.

Further, in the first embodiment, the in-car operation panel 11 to be operated for the manual operation of the car is provided in each of the cars.

In this case, when the on-car presence detection unit 6 has detected the presence of a person on top of at least one of the plurality of cars, the car operation approval unit 121 cancels the operation on the in-car operation panels 11 of all the plurality of cars.

In this manner, when a person is present on top of at least one car, the operation on the in-car operation panels 11 of all the cars is canceled. Therefore, unintended movement of each of the cars for the maintenance worker who is present on top of the car can be prevented. Further, when operating the in-car operation panel 11, the maintenance worker is not required to confirm the absence of a person on top of all the cars. Therefore, the work efficiency is improved.

Further, in the first embodiment, the car operation approval unit 121 may further determine whether or not to approve the operation on the in-car operation panels 11 by using the results of detection by the on-car presence detection units 6 and the result of detection by the in-pit presence detection unit 8.

In this case, when the presence of a person on top of at least one of the plurality of cars has been detected by the on-car presence detection unit 6, the car operation approval unit 121 cancels the operation on the in-car operation panels 11 of all the plurality of cars regardless of the result of detection by the in-pit presence detection unit 8.

Meanwhile, when the presence of a person on top of each of the cars or in the pit 7 has not been detected by the on-car presence detection units 6 and the in-pit presence detection unit 8, the car operation approval unit 121 approves the operation on the in-car operation panels 11 of all the plurality of cars.

In this manner, when a person is present on top of at least one car, the operation on the in-car operation panels 11 of all the cars is canceled. Therefore, unintended movement of each of the cars for the maintenance worker who is present on top of the car and the maintenance worker who is present in the pit 7 can be prevented. Further, when operating the in-car operation panel 11, the maintenance worker is not required to confirm the absence of a person on top of all the cars and the absence of a person in the pit 7. Therefore, the work efficiency is improved.

REFERENCE SIGNS LIST

1 hoistway, 2A, 2B car, 3 landing, 4 landing door, 5 car door, 6 on-car presence detection unit, 7 pit, 8 in-pit presence detection unit, 9 buffer, 10 buffer cap, 10*a* contact sensor, 11 in-car operation panel, 12 elevator control device, 15 on-car operation panel, 16 traveling cable, 121 car operation approval unit, 122 storage unit

The invention claimed is:

1. An elevator device, which includes a plurality of cars installed in the same hoistway, the elevator device comprising:

on-car presence detectors, each being configured to detect presence of a person on top of a corresponding one of the plurality of cars;

on-car operation panels, each being disposed on top of a corresponding one of the plurality of cars and to be operated for a manual operation of the corresponding one of the plurality of cars; and a car operation approver to approve or cancel an operation on the on-car operation panels based on results of detection by the on-car presence detectors, wherein, when the on-car presence detectors have detected the presence of persons on two or more of the plurality of cars, the car operation approver cancels the operation on the on-car operation panels of all the plurality of cars, and wherein, when the on-car presence detector has detected the presence of a person on one of the plurality of cars, the car operation approver approves the operation on the on-car operation panel of any one of the plurality of cars.

2. The elevator device according to claim 1, further comprising an in-pit presence detector, which is installed in a pit formed at a lower end of the hoistway, and is configured to detect presence of a person in the pit, wherein, when the in-pit presence detector detects the presence of a person in the pit, the car operation approver cancels the operation on the on-car operation panels of all the plurality of cars regardless of the results of detection by the on-car presence detectors.

3. The elevator device according to claim 2, wherein, when the on-car presence detector has detected presence of a person on top of one of the plurality of cars and the in-pit presence detector has failed to detect presence of a person in the pit, the car operation approver approves the operation on the on-car operation panel of one of the plurality of cars.

4. The elevator device according to claim 2, further comprising:

evacuation space ensuring devices, each being installed on a corresponding one of the plurality of cars and being configured to abut against an obstacle that is present in a raising and lowering direction of the corresponding one of the plurality of cars to ensure an evacuation space in the raising and lowering direction; and evacuation space ensuring detectors, each being configured to detect that the evacuation space ensuring device is prepared on top of a corresponding one of the plurality of cars, wherein, when preparation of the evacuation space ensuring device has failed to be detected for at least one of the plurality of cars by the evacuation space ensuring device, the car operation approver cancels the operation on the on-car operation panels of all the plurality of cars regardless of the results of detection by the on-car presence detectors and the result of detection by the in-pit presence detector, and wherein, when the on-car presence detector has detected presence of a person on top of one of the plurality of cars, the evacuation space ensuring detector has detected the preparation of the evacuation space ensuring device on top of the one of the plurality of cars, and the in-pit presence detector has failed to detect the presence of a person in the pit, the car operation approver approves the operation on the on-car operation panel of one of the plurality of cars.

5. The elevator device according to claim 2, further comprising in-car operation panels, each being disposed inside a corresponding one of the plurality of cars and being operated for a manual operation of the corresponding one of the plurality of cars, wherein, when the on-car presence detector has detected presence of a person on top of at least one of the plurality of cars, the car operation approver cancels the operation on the in-car operation panels of all the plurality of cars, and wherein, when presence of a person on top of the corresponding one of the plurality of cars or in the pit has failed to be detected by the on-car presence detectors and the in-pit presence detector, the car operation approver approves the operation on the in-car operation panels of all the plurality of cars.

6. The elevator device according to claim 1, further comprising:

evacuation space ensuring device, each being installed on a corresponding one of the plurality of cars and being configured to abut against an obstacle that is present in a raising and lowering direction of the corresponding one of the plurality of cars to ensure an evacuation space in the raising and lowering direction; and evacuation space ensuring detectors, each being configured to detect that the evacuation space ensuring device is prepared on top of a corresponding one of the plurality of cars, wherein, when installation of the evacuation space ensuring device has failed to be detected for at least one of the plurality of cars by the evacuation space ensuring device, the car operation approver cancels the operation on the on-car operation panels of all the plurality of cars regardless of the results of detection by the on-car presence detectors, and wherein, when the on-car presence detector has detected presence of a person on top of one of the plurality of cars and the evacuation space ensuring detector has detected the installation of the evacuation space ensuring portion device on top of the one of the plurality of cars, the car operation approver approves the operation on the on-car operation panel for one of the plurality of cars.

7. The elevator device according to claim 1, further comprising in-car operation panels, each being disposed inside a corresponding one of the plurality of cars and being operated for a manual operation of the corresponding one of the plurality of cars, wherein, when the on-car presence detector has detected presence of a person on top of at least one of the plurality of cars, the car operation approver cancels the operation on the in-car operation panels of all the plurality of cars.

* * * * *